United States Patent [19]

Woestman

[11] Patent Number: 4,709,633

[45] Date of Patent: Dec. 1, 1987

[54] CIRCUIT FOR CONTROLLING THE INK LEVEL OF AN INTAGLIO PRINTING DEVICE

[75] Inventor: John W. Woestman, Lancaster, Pa.

[73] Assignee: RCA Corporation, Princeton, N.J.

[21] Appl. No.: 37,896

[22] Filed: Apr. 13, 1987

[51] Int. Cl.[4] ..... B41F 1/16; B41F 31/02

[52] U.S. Cl. ..... 101/163; 101/169; 101/DIG. 24

[58] Field of Search ..... 101/150, 158, 157, 169, 101/163, 366, 35, 41, 42–44, DIG. 24

[56] References Cited

U.S. PATENT DOCUMENTS

| | | | |
|---|---|---|---|
| 4,066,014 | 1/1978 | Haaften | 101/366 |
| 4,121,222 | 10/1978 | Diebold et al. | 101/366 |
| 4,473,008 | 9/1984 | Heyman | 101/150 |
| 4,535,693 | 8/1985 | Belvederi | 101/366 |

*Primary Examiner*—J. Reed Fisher

*Attorney, Agent, or Firm*—E. M. Whitacre; D. H. Irlbeck; L. L. Hallacher

[57] ABSTRACT

A control circuit for controlling ink supplied to the inking surface of an intaglio printing device includes a sensor for sensing voids in the ink on the inking surface. The control circuit provides a predetermined volume of ink to a reservoir when such a void is detected. A timer inhibits the control circuit for a predetermined time after each ink transfer to avoid overfilling the reservoir.

11 Claims, 3 Drawing Figures

CIRCUIT FOR CONTROLLING THE INK LEVEL OF AN INTAGLIO PRINTING DEVICE

BACKGROUND

This invention relates generally to control circuits and particularly to such a circuit for controlling a system for supplying ink to an intaglio printing device.

Intaglio printing is a technique of printing bar codes on nonporous objects and is well known in the art. Typically in such printing, a smooth inking surface contains a substantially rectangular aperture. A plurality of substantially flat inking bars are stacked together and are arranged along one dimension of the aperture such that the combined thickness of the bars substantially fill the aperture. The inking bars include an inking edge which spans the other dimension of the aperture such that the inking edges substantially fill the other aperture dimension. The inking bars have a thickness which is determined by the desired width of the bars in the bar code to be printed. The entire inking surface, including the inking edges of the bars, are covered with ink by a mechanical member which drags ink from a reservoir across the inking surface. A squeegee-like scraper member is used to remove ink from the inking surface. Prior to inking the inking surface, selected inking bars are depressed to lie a small distance below the inking surface to form cavities between the nondepressed bars. Ink fills the cavities and remains in the cavities after the ink is removed from the inking surface. A nonporous, resilient member is depressed against the inking bars and enters the cavities to transfer the ink from the cavities to the resilient member. The resilient member is removed from the inking surface and brought into contact with the object upon which the bar code is to be printed to effect the transfer of the ink from the resilient member to the item to be identified.

In intaglio printing devices of the type described above, ink is applied to the inking surface and the inking bars by pulling an ink spreader through a reservoir of the ink which is immediately adjacent to the inking surface. The ink is thus spread over the entire inking surface as well as the inking edges of the bars. Subsequently an ink scraper removes ink from the inking surface and from the inking edges of the printing bars leaving ink in the depressions formed between the nondepressed inking bars. In instances when the ink supply in the reservoir becomes low, the ink is not uniformly applied and voids can exist in the ink on the inking surface, or on the inking edges of the bars. In such instance inaccurate codes can be printed on the object. Accordingly, there is a need for a system for detecting the need for raising the level of ink in the inking reservoir while simultaneously avoiding overfilling the ink reservoir. The present invention fulfills these needs.

CROSS-REFERENCE TO RELATED APPLICATION

The present invention can be used to control the inking device described in application Ser. No. 005,808, entitled "Intaglio Inking Device", filed Jan. 21, 1987 by Gerard Samuels and Paul R. Smith

SUMMARY

A control circuit for controlling a system for supplying ink to an intaglio printing device. The printing device includes an inking surface and a set of moveable bars for setting a bar code is arranged in the inking surface. An ink spreader applies ink from a reservoir to the bars, and an ink scraper removes ink from the inking surface. An ink supply supplies ink to the reservoir. A plurality of proximity switches is associated with the ink supply and provides the level of ink in the ink supply to the control circuit. Ink from the ink supply is transferred to the reservoir by a means for transferring ink. The control circuit includes sensor means associated with the ink scraper for sensing voids in the ink on the inking surface in the proximity of the moveable bars. A switch means is responsive to the sensor means and actuates the control circuit. A generator means energizes the means for transferring to effect transfer of ink from the supply to the reservoir in response to the sensor. A counter means is responsive to the generator means and is set to a preselected count. A timer means is responsive to the counter means and deactivates the generator means for a preselected time when the counter means reaches the preselected count whereby a preselected volume of ink is transferred to the reservoir, and the means for transferring is disabled during the preselected time.

DETAILED DESCRIPTION

Figure 1:
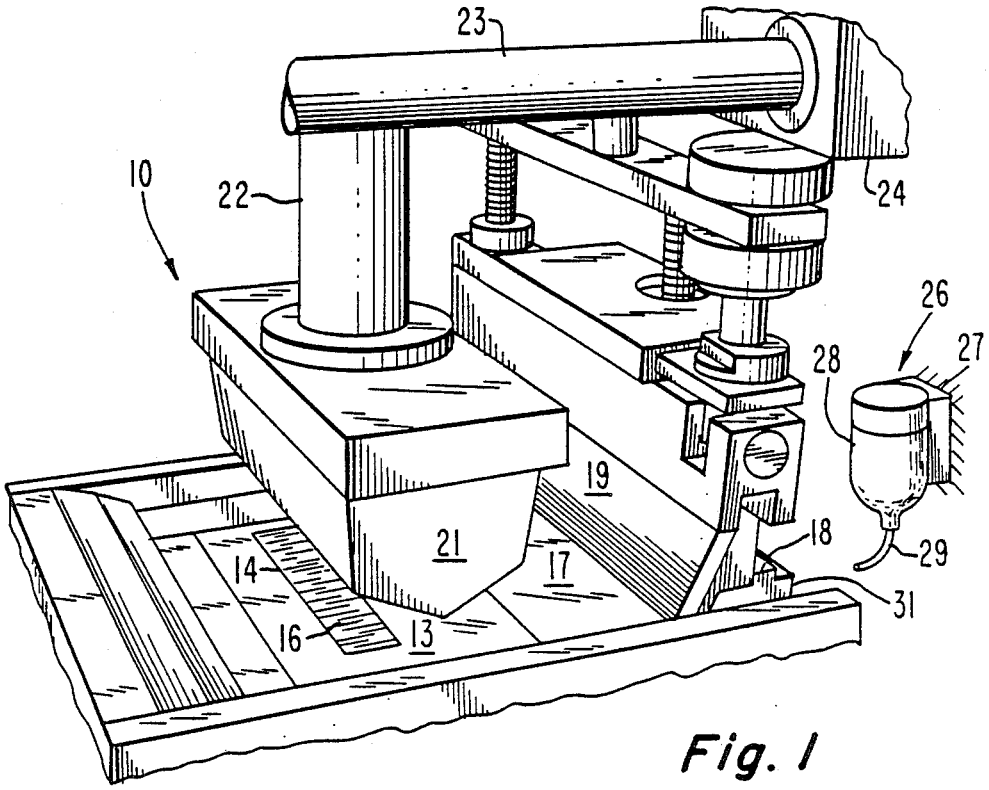
FIG. 1 is an isometric of a portion of an inking device with which the present invention can be used.

In FIG. 1, an intaglio printing device 10 includes an inking surface 13 having a substantially rectangular aperture 14. A plurality of inking bars 16 are stacked together to fill one dimension of the aperture 14 and span the other dimension of the aperture 14. An ink reservoir 17 is arranged in the proximity of the inking surface 13. An ink spreader 19 has one edge resting in the ink in the reservoir 17, and an ink scraper 18 is arranged in the proximity of the spreader 19.

A substantially nonporous ink transfer member 21 is supported above the inking bars 16. The ink transfer member 21 is supported by a vertical shaft 22 to slide between a horizontal shaft 23 and a similar parallel shaft, not shown. The vertical shaft 22 pivots to a horizontal position, by a mechanism, not shown, as the horizontal shaft 23 slides in a support 24. To effect the transfer of ink from the inking bars 16, the transfer member 21 is moved downwardly into contact with the inking bars and then retracted upwardly to a preselected height. The shaft 22 and transfer member 21 are rotated to a horizontal position and moved horizontally along the horizontal shaft 23 into contact with the object (not shown) upon which the bar code is to be printed. Typically, when the object upon which a bar code is to be printed is a kinescope faceplate, the ink is similar to the frit material which is used to join the faceplate and the funnel portion of the kinescope.

Ink is supplied to the reservoir 17 by an ink transfer mechanism 26 including a motor 27 and a cylinder 28. The motor 27 is actuated to supply a predetermined amount of ink from the supply 28 to the reservoir 17 by way of a tube 29. A predetermined amount of ink is supplied to the reservoir 17 upon each actuation of the motor 27 in a manner described in detail hereinafter with respect to FIGS. 2 and 3.

Ink is supplied to the inking surface 13 by pulling the ink spreader 19 through the ink in the reservoir 17 to fully coat the printing surface 13 and the printing edges of the inking bars 16 within the aperture 14 of the printing surface 13. Ink is removed from the printing surface 13, and the inking edges of the bars 16, leaving ink between the cavities formed between the nondepressed inking bars by moving a wiper 18 across the printing surface 13. The need for supplying additional ink to the reservoir 17 is detected by the use of a sensor 31 which is affixed to the wiper 18, and which moves with the wiper 18. Preferably, the sensor 31 includes an LED array and photosensor which receives reflected light from the ink and from the inking surface 13. When the ink in the reservoir is low, there are voids in the ink spread across the inking surface 13 and these voids will change the reflected light received by the photosensor from the LEDs. The change in reflected light is utilized to actuate the motor 27 to supply a predetermined volume of ink to the reservoir 17. The LED arrays and the photosensors are commercially available items and any of several types available can be used.

Figure 2:
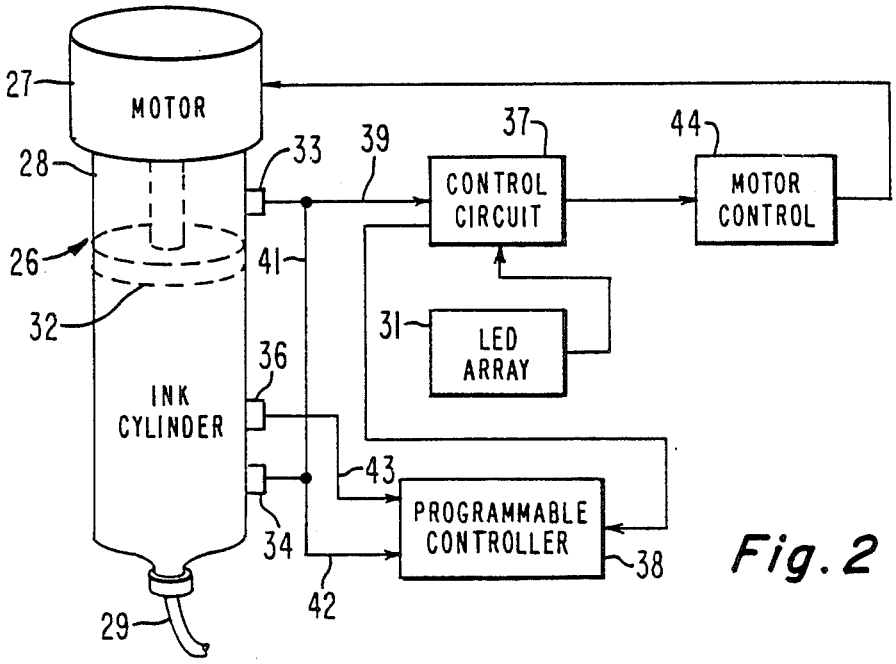
FIG. 2 is a block diagram of a preferred embodiment.

In FIG. 2, the ink transfer mechanism 26 includes the motor 27, which preferably is a stepper motor, and a piston 32, which is internal of the cylinder 28. Each step of the motor forces a preselected volume of ink from the cylinder 28 into the tubulation 29 and thus ultimately to the reservoir 17 (FIG. 1). A plurality of proximity switches 33, 34 and 36 are associated with the cylinder 28 to detect the presence of the piston 32 at several positions within the cylinder. The proximity switch 33 is coupled to a control circuit 37 and a programmable controller 38 by output lines 39 and 41, respectively. The proximity switch 33 detects the location of the cylinder 32 to indicate that the cylinder 28 is full. The proximity switch 34 is also coupled to the programmable controller 38 and the control circuit 37 by output lines 42 and 39, respectively. Proximity switch 34 also detects the position of the piston 32 and yields an output signal to indicate that the ink cylinder 28 is in need of immediate filling. Proximity switch 36 is coupled to the programmable computer 38 by a line 43 and is used to flash a warning light when the ink level within the cylinder 28 is getting low and approaching the need for refilling. The control circuit 37 is explained in detail hereinafter with respect to FIG. 3 and is used to control the operation of the motor 27 by way of a motor control 44. The motor control 44 is designed specifically for the particular type of motor which is used to force ink from the cylinder 28 and thus is manufactured by the manufacture of the motor 27 and is purchased along with the motor.

Figure 3:
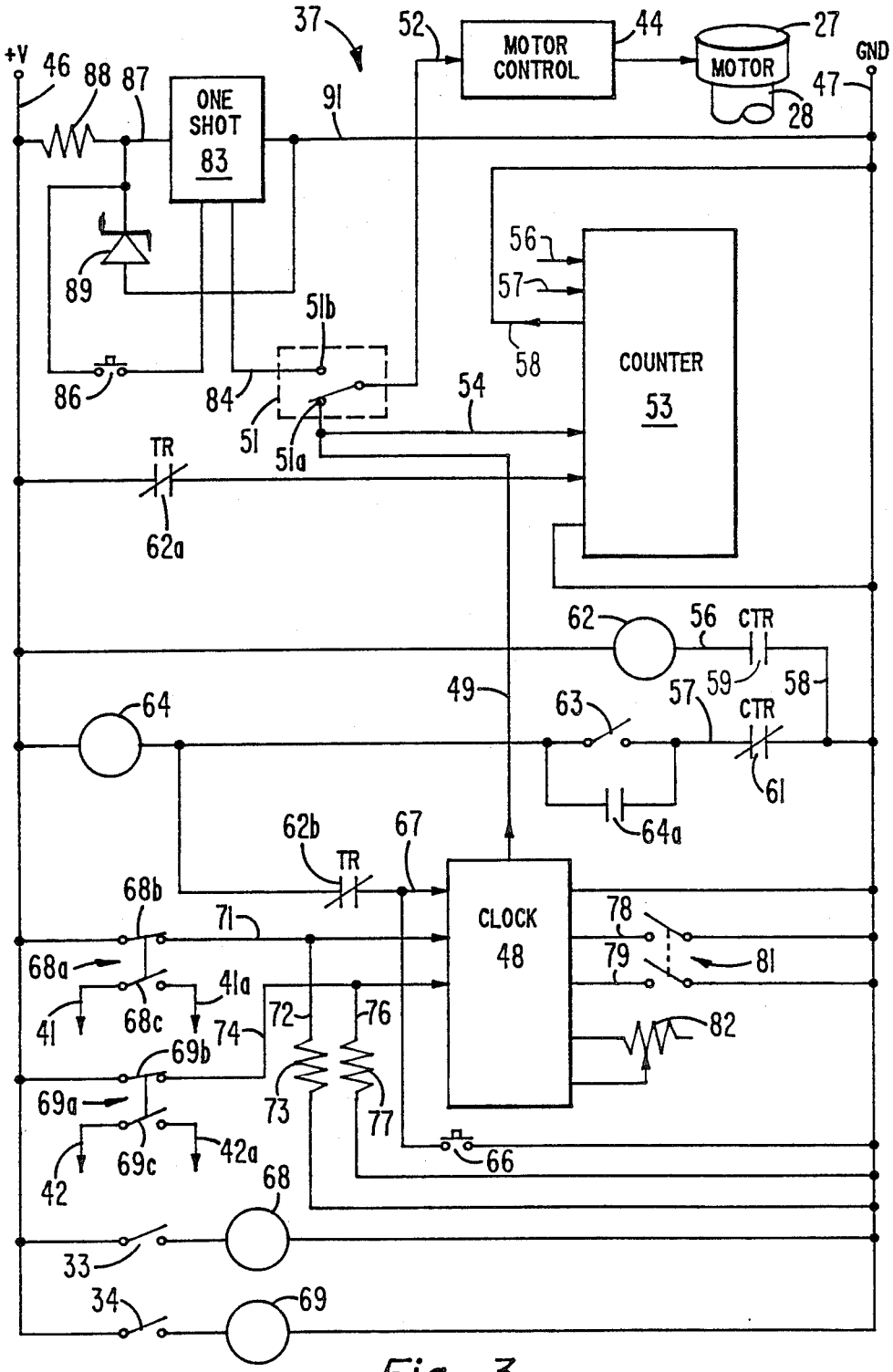
FIG. 3 is a more detailed showing of the control circuit of FIG. 2.

The control circuit 37 of FIG. 2 is shown in detail in FIG. 3. The circuit includes a voltage biasing line 46 which is biased with a positive DC potential, such as 24 volts, and a ground line 47. A generator means 48 has an output line 49 which is coupled to the motor control 44 through a selector switch 51 and an output line 52. When the motor 27 is a stepping motor, the generator means 48 is a clock pulse generator which supplies stepping pulses to the motor 27 through the lines 49, the selector switch 51 and the output line 52.

The output line 49 of the clock pulse generator 48 is also coupled to a counter 53 by a line 54. The counter 53 is set to a preselected count so that upon each actuation of the clock pulse generator the stepper motor 27 is stepped for a predetermined number of steps to cause a preselected volume of ink to be transferred from the cylinder 28 to the reservoir 17. The counter 53 includes input lines 56 and 57 and an output line 58 which is coupled to ground. A normally open relay 59 is internal to the counter 53. Similarly, a normally closed relay 61 is internal to the counter 53 and is coupled between the line 57 and the grounded line 58. The internal relays 59 and 61 are shown external of the counter 53 for convenience of illustration. The counter 53 can be a model 354A-350Q-30PX counter sold by Automatic Timing Controls. When an input is initially received from the clock pulse generator 48 the counter 53 begins counting, and when the count reaches the preselected count the relays 59 and 61 change states and remain changed until the counter 53 is reset at the expiration of a preselected time period.

A timer coil 62 is arranged between the line 56 of the relay 59 and the voltage biased line 46. The timer coil 62 controls two normally closed relays **62*a* and 62*b*. The coil 62 is energized when the relay 59 of the counter 53 closes resulting in the opening of the relays 62*a* and 62*b*. The opening of the relay 62*a* prevents the counter 53** from being reset until the timer times out.

A photosensor switch 63 is normally opened and closes when the photosensor associated with the LED array 31 senses a void in the ink on the inking surface 13. A coil 64 is arranged between the biased line 46 and the photosensor switch 63. The coil 64 controls a normally open relay **64*a* which shunts the photosensor switch 63. The coil 64 can also be connected to the ground line 47 through the normally closed timer relay 62*b* and a push-button switch 66. The relay 62*b* is also coupled to the slow input of the clock pulse generator by a line 67. Accordingly, the motor 27 can be actuated by manually closing the switch 66 to manually fill the reservoir 17**.

A coil 68 is coupled between the proximity switch 33 and the ground line 47. The other side of the proximity switch 33 is coupled to the biased line 46. A double pole switch **68*a*, having a normally closed contact 68*b* and a normally open contact 68*c*, is responsive to the energization of the coil 62. Actuation of the proximity switch 33 energizes the coil 68 and therefore the contacts 68*b* and 68*c* change state when the proximity switch 33 closes in response to the detection of the piston 32 within the cylinder 28. Similarly, a coil 69 is coupled between the proximity switch 34 and the ground line 47. The other side of the proximity switch 34 is coupled to the biased line 46. A double pole switch 69*a*, having a normally closed contact 69*b* and a normally open contact 69*c*, is responsive to the coil 69. The coil 69 is energized when the limit switch 34 detects the presence of the piston 32 and the contacts 69*b* and 69*c* change state. The output lines 41, 41*a* and 42, 42*a* of the relays 68*a* and 69*a*, respectively, are coupled to the programmable computer 38 of FIG. 2**.

The normally closed contact **68*b* of the switch 68*a* is coupled by a line 71 to an input of the pulse generator 48. The line 71 is coupled to the ground line 47 by a line 72, which includes a resistor 73. Also, the normally closed contact 69*b* of the switch 69*a* is coupled by a line 74 to an input of the pulse generator 48. The line 74 is coupled to the ground line 47 by a line 76, which includes a resistor 77. Accordingly, the normally closed contacts 68*b* and 69*b* positively bias the clock pulse generator 48 to enable the generator. The clock pulse generator 48 is therefore inhibited when either of the normally closed contacts 68*b* or 69*b* opens in response to the actuation of one of the proximity switches 33 or 34**.

Two output lines 78 and 79 of the clock pulse generator 48 are coupled to the ground line 47 through a double pole switch 81. The double pole switch 81 is manually closed to reverse the motion of the stepper motor 27 to rapidly return the piston 32 to the highest position in preparation of replenishing the ink supply within the cylinder 28. A potentiometer 82 can be used to change the clock pulse rate of the clock pulse generator 48.

The selector switch 51 includes an automatic select position 51*a* and a remote select position 51*b*. When the switch 51 is in the automatic position 51*a* the stepper motor 27 is energized by the clock pulse generator 48. When the selector switch 51 is in the manual position 51*b*, the motor 27 can be controlled by a one-shot generator 83. An output line 84 of the one-shot 83 is coupled to the motor 27 by the switch 51*b* and the line 52. A pushbutton switch 86 is manually closed to cause the one-shot 74 to step the motor 27 one step. Accordingly, the piston 32 within the ink cylinder 28 can be moved during filling to bring the piston 32 into contact with the ink within the cylinder 28. An input line 87 of the one-shot 83 is coupled to the voltage bias line 46 through a resistor 88, which is used to drop the voltage to the operation voltage of the one shot. A zener diode 89 couples the input line 87 to ground by way of a line 91. The zener 89 merely assures that the input voltage to the one shot remains at the maximum required to properly operate the one shot 83.

The programmable controller 38 can be used to flash an indicator light when the proximity switch 36 detects the presence of the piston 32 within the cylinder 28 to warn that the ink supply is getting low. Additionally, if desired, the programmable controller 38 can be used to enable a prime circuit when a new cartridge is to be loaded. Also, if desired the programmable controller can be used to gate the ink sensor which includes the LED array 31 and the light sensor so that the light sensor only detects ink voids which are in the close proximity of the inking bars 16. Accordingly, the exact details of the programmable controller 38 are optional and are within the purview of those skilled in the art.

In operation, when the LED array 31 and the associated photodetector detect a void in the ink on the inking surface 13, the photosensor switch 63 is temporarily closed to ground the coil 64 and effect the closing of the relay 64*a*. The input line 67 to the clock pulse generator 48 is grounded through the timer relay 62*b* and the relay 64*a*. and the clock pulse generator 48 begins supplying clock pulses to the stepper motor 27 by way of the output line 49, the selector switch 51 and the line 52.

The clock pulses from the clock pulse generator 48 also are applied to the counter 53 by the lines 49 and 54. The counter 53 therefore starts counting from the preset count as the clock pulse generator 48 supplies the clock pulses to the stepper motor 27. Accordingly, a predetermined volume of ink is applied to the reservoir 17 for each step of the stepper motor 27. When the counter 53 reaches the count of zero, the normally open relay 59 and the normally closed relay 61 within the counter 53 change states. When normally open relay 59 closes, the coil 62 of the timer is energized causing normally closed relays 62*a* and 62*b* to open, thereby inhibiting the counter 53 and the clock pulse generator 48. A few cycles of the ink spreader 19 are required to cover the inking surface 13 to ensure that the photosensor associated with the LED array 31 does not receive a signal from a bare spot and cause the system to inappropriately call for more ink to be put into the reservoir 17. Also, the ink has a very high viscosity and therefore it takes time for the ink to flow into the reservoir. Additionally, the ink must be pushed slowly from the cylinder 28 to avoid bursting the cylinder 28 or the supply line 29. Because of the very high viscosity of the ink it takes several minutes to get the ink from the cylinder 28 into the reservoir 17 and to spread the ink over the inking surface 13. The timer therefore has a control which permits the adjustment of the delay period for up to six minutes, with less than one minute being the typical time delay. When the timer times out the relays 62*a* and 62*b* of the timer return to the normally closed state, and the counter 53 and clock pulse generator 48 reset to the initial operating condition. Additionally, when the counter 53 counts to zero the normally closed relay 61 opens thereby de-energizing the coil 64 to cause the opening of relay 64*a* and the system is again ready to receive a signal from the photosensor associated with the LED array 31.

What is claimed is:

1. A control circuit for controlling a system for supplying ink to an intaglio printing device, said printing device having an inking surface with a set of moveable bars for setting a bar code arranged in said inking surface, an ink spreader for applying ink from a reservoir to said bars, an ink scraper for removing ink from said inking surface, an ink supply for supplying ink to said reservoir, a plurality of proximity switches associated with said ink supply for providing the level of ink in said ink supply to said control circuit; and means for transferring ink from said ink supply to said reservoir; said control circuit comprising:

sensor means associated with said ink scraper for sensing voids in the ink on said inking surface in the proximity of said moveable bars;

switch means responsive to said sensor means for actuating said control circuit;

generator means for energizing said means for transferring to effect transfer of ink from said supply to said reservoir in response to said sensor;

counter means responsive to said generator means, said counter means being set to a preselected count;

timer means responsive to said counter means, said timer means deactivating said generator means for a preselected time when said counter means reaches said preselected count whereby a preselected volume of ink is transferred to said reservoir, and whereby said means for transferring is disabled during said preselected time.

2. The control circuit of claim 1 wherein said means for transferring ink includes a stepper motor.

3. The control circuit of claim 2 wherein said generator means is a clock pulse generator for supplying pulses to said stepper motor and to said counter means.

4. The control circuit of claim 3 wherein said sensor means includes an array of light emitting diodes and sensor switch means responsive to said array for actuating said control circuit in response to voids in said ink on said inking surface.

5. The control circuit of claim 4 further including selector switch means for selecting manual and automatic actuation of said stepper motor; and single pulse generation means for manually providing single pulses to said stepper motor.

6. The control circuit of claim 5 further including means for rapidly returning said stepper motor to a home position.

7. The control circuit of claim 6 including at least two of said proximity switches, a first of said switches indicating when said ink supply is full and a second of said switches indicating when said ink supply is low.

8. The control circuit of claim 1 wherein said means for transferring ink includes a motor, and wherein said ink supply includes an ink cylinder having an internal piston responsive to said motor whereby actuation of said motor transfers ink from said inking surface to said reservoir.

9. The control circuit of claim 8 wherein said motor is a stepper motor whereby each step of said motor transfers a preselected volume of ink to said reservoir.

10. The control circuit of claim 9 including at least two of said proximity switches, a first of said switches indicating when said ink supply is full and a second of said switches indicating when said ink supply is low.

11. The control circuit of claim 10 including an additional proximity switch for indicating when said ink supply is getting low.

* * * * *